United States Patent [19]

Kremendahl

[11] Patent Number: 4,715,131

[45] Date of Patent: Dec. 29, 1987

[54] ORTHOPEDIC SUPPORTING MEMBER, PARTICULARLY ORTHOPEDIC SHOE INSERTS, AND METHOD OF ITS MANUFACTURE

[75] Inventor: Juergen Kremendahl, Remscheid, Fed. Rep. of Germany

[73] Assignee: Globus Fussstützenfabrik Karl Kremendahl, Remscheid, Fed. Rep. of Germany

[21] Appl. No.: 830,682

[22] Filed: Feb. 18, 1986

[30] Foreign Application Priority Data

Mar. 28, 1985 [DE] Fed. Rep. of Germany ... 8509263[U]

Jul. 10, 1985 [EP] European Pat. Off. ..... 85112695.3

[51] Int. Cl.[4] ..... A43B 13/38

[52] U.S. Cl. ..... 36/44; 36/43; 128/595

[58] Field of Search ..... 36/43, 44, 71, 76 C; 128/586, 595, 607, 615–619, 621–623

[56] References Cited

U.S. PATENT DOCUMENTS

| | | | |
|---|---|---|---|
| 1,142,848 | 6/1915 | Scholl | 128/616 |
| 1,369,375 | 2/1921 | Barrett | 128/607 |
| 2,330,398 | 9/1943 | Vass | 128/621 |
| 3,861,398 | 1/1975 | Leydecker | 128/615 |
| 4,133,117 | 1/1979 | Bradley | 36/76 C |
| 4,231,169 | 11/1980 | Toyama et al. | 36/44 |
| 4,241,124 | 12/1980 | Kremer et al. | 36/43 |
| 4,517,981 | 5/1985 | Santopietro et al. | 36/43 |
| 4,520,581 | 6/1985 | Irwin et al. | 128/595 |
| 4,581,524 | 4/1986 | Hoekman et al. | 235/493 |
| 4,602,442 | 7/1986 | Revill et al. | 36/43 |

FOREIGN PATENT DOCUMENTS

| | | | |
|---|---|---|---|
| 520761 | 7/1953 | Belgium | 128/595 |
| 891064 | 9/1953 | Fed. Rep. of Germany | 128/595 |
| 893316 | 10/1953 | Fed. Rep. of Germany | 128/595 |
| 1491133 | 4/1969 | Fed. Rep. of Germany | 36/71 |
| 3212644 | 10/1983 | Fed. Rep. of Germany | 36/88 |
| 3304537 | 8/1984 | Fed. Rep. of Germany . | |
| 197422 | 7/1938 | Switzerland | 128/616 |
| 296308 | 10/1929 | United Kingdom | 128/586 |
| 335629 | 10/1930 | United Kingdom | 128/596 |
| 480304 | 2/1938 | United Kingdom | 128/586 |

*Primary Examiner*—Werner H. Schroeder
*Assistant Examiner*—Steven N. Meyers
*Attorney, Agent, or Firm*—Michael J. Striker

[57] ABSTRACT

An orthopedic support part of synthetic plastic material is composed of polyethylene terephthalate and has zones of different stiffnesses. A method of manufacturing of the orthopedic support part includes injection casting of polyethylene terephthalate, and provision of different temperatures in an injection casting tool for obtaining the zones of different stiffnesses.

15 Claims, 2 Drawing Figures

ORTHOPEDIC SUPPORTING MEMBER, PARTICULARLY ORTHOPEDIC SHOE INSERTS, AND METHOD OF ITS MANUFACTURE

BACKGROUND OF THE INVENTION

The present invention relates to an orthopedic supporting member, particularly an orthopedic supporting insert of a synthetic plastic material. The invention also relates to a method of manufacturing the orthopedic supporting member.

In the orthopedy, supporting members are known which must have different properties in their different zones. For example, in an orthopedic shoe insert with a supporting region for the central part of the foot and a heel region it is necessary that the heel region be elastically flexible and the supporting region be relatively stiff, but also elastic, and moreover after-deformable in correspondence with individual shapes or feet. These requirements must also be satisfied in other orthopedic supporting members, such as for example, cervical ortheses, peroneus splints, etc.

Orthopedic supporting members, particularly orthopedic shoe inserts of thermoplastic synthetic plastic material which are after-deformable are known. Particularly in the event of the orthopedic shoe inserts with the heel region, it is necessary for guaranteeing a sufficient support stiffness to select such a material thickness which causes an unpleasant so-called charge in the shoe and makes wearing of the shoe inconvenient. Because of the required material quantity and thickness, the product must be heavy and rigid, and in many cases also expensive. Zones with different properties to satisfy the respective requirements are difficult to implement. Zones, for example in the heel region in an orthopedic shoe insert, are ground thinner to render them different properties. The thinner zones are susceptible to breakage and particularly in a transition region to the central foot region to which the weight of a user is applied.

An orthopedic shoe insert is disclosed in the DE-OS No. 3,304,537, which is composed of a thermoplastic synthetic plastic material and maintains at the normal temperature of use its predetermined anatomically designed shape in elastic spring manner, while at higher temperature it is plastically deformable and maintains its acquired shape after cooling. The synthetic plastic material which is used here is a casting resin, particularly a glass fiber-reinforced acrylic casting resin. The reinforcement is formed by several layers of a hose tricot fabric. Approximately between 10 and 14 hose tricot fabric layers are used here. During the manufacture of this known shoe inserts, different intermediate layers of the glass fabric material are applied in a stepped manner, and the heel step surface can be made very thin with only a few layers. As a result of this, the heel step surface is less stiff than the other parts of the shoe insert. The method of manufacturing the above described shoe insert is extremely expensive. Different stiffnesses are provided by different thickness of the synthetic plastic material and by the number of the fabric inserts. Moreover, only a blank can be made which subsequently must be worked by grinding or milling.

SUMMARY OF THE INVENTION

Accordingly, it is an object of the present invention to provide a one-piece orthopedic supporting member, particularly a one-piece orthopedic shoe insert of a synthetic plastic material, which is after-deformable in a sufficient and reproducible manner, which can be made very thin and provides the required supporting force without the danger of breakage, and which is price-favorable and provided in a simple manner with zones of different properties.

In keeping with these objects and with others which will become apparent hereinafter, one feature of the present invention resides, briefly stated, in an orthopedic supporting member of a synthetic plastic material, which is composed of polyethylene terephthalate and has zones of different stiffness. It is also an advantageous feature of the present invention to provide a method of manufacturing an orthopedic supporting member which is made by injection casting of polyethylene terephthalate, and zones of different properties are produced by providing different temperatures in local parts of an injection casting tool.

In accordance with the present invention, an orthopedic supporting member, particularly an orthopedic shoe insert, is produced of a thermoplastic linear polyester (polyalkylene terephthalate) and particularly from polyethylene terephthalate which is referred to hereinbelow with the internationally accepted abbreviation PETP.

A shoe insert of glass fiber-reinforced PETP is known which, however, has no heel region. The shoe insert is extremely stiff and because of this, cannot be used. Moreover, it was not proposed to form a shoe insert with a one-piece heel region formed of this synthetic plastic material. In no way it could expected that this synthetic plastic material would be suitable to provide a shoe insert with a one-piece molded heel region.

With the selection of this synthetic plastic material, it has been made possible to provide an orthopedic supporting member, particularly an orthopedic shoe insert, which can be optimized with respect to its properties. It is possible to form zones of different thicknesses and independently of the thickness of different elasticity and stiffness or supporting strength and to select such dimensions with which the required properties cannot be achieved with the use of different synthetic plastic materials.

In the orthopedic shoe insert in accordance with the present invention, the heel region has a thinner material than the supporting region, and is elastically bendable, while the supporting region has such a supporting stiffness that under the loading with the body weight applied by a foot and under the temperature which takes place in the shoe, it remains formstable. The thickness in the heel region amounts for example to 0.8–1.1 mm, whereas the thickness in the support region amounts to approximately 3.2–3.6 mm. Thereby different properties (elasticity-stiffness) are provided in these regions substantially not by the different thicknesses, but by different material structures as will be explained hereinbelow.

The polyalkylene terephthalate is considered to be structural synthetic plastic material and as a rule is used in the fields where high size accuracy and high time-dependent creep strength are required, and particularly where high sliding and wear properties are stressed. It is known that the PETP possesses these properties. Because of low crystallization speed, it can exist depending on working conditions and raw material type, in amorphous-transparent or partially crystalline state (steady 30–40% crystallinity). When the tool temperatures reach maximum 40° C. an amorphous structure takes place, while at the high two temperatures a partially-crystalline structure is provided. The crystallization degree can be increased by nucleus agent. On the market the PETP is used with filling and reinforcing substances, such as with glass fibers, glass balls, minerals, talc. In the amorphous state the PETP is transparent, and in the partially-crystalline state it is opaque-white. PETP in partially-crystalline state has a high hardness, stiffness and strength with good viscosity up to −40° C. It has a good creep properties and low wear with favorable sliding properties. PETP is provided for increasing its strength, E-coefficient and creep strength, with up to 30% of glass fibers. Partially-crystalline PETP is very highly thermally resistant, and can be used from −40° C. to 100° C. In amorphous condition the shape stability is lower, the crystallite melting region of PETP lies between 255° C. and 258° C. PETP can be available on the market as granulate. It can be worked by injection casting processes. It is recommended to provide mass temperatures of 260° C.–290° C. and injection pressure of 1,000–1,700 bar. Favorable conditions can be adjusted by glass fiber reinforcement. The tool temperatures must be from 30° C. to 140° C. Amorphous types must be worked at lower tool temperatures and partially-crystalline types must be worked with higher tool temperatures.

Some of these known properties do not interfere with the utilization for the inventive purpose. The high injection pressure during injection casting and particularly danger of the shrinking, as well as the requirement of high casting cross-sections are not obvious for the utilization. In particular, in the event of relatively thin orthopedic shoe inserts, no great casting cross-section can be guaranteed. Moreover, it was not known that in a one-piece supporting member zones of extremely different properities (elasticity-stiffness) can be obtained.

The inventive orthopedic supporting member can be produced in injection casting process. When PETP reinforced for example with glass fibers is used, it can be produced by mixing a commercial glass fiber-containing granulate with a commercial glass fiber-free granulate. It is advantageous when the granulate grain size is in the region of 1–5 mm, advantageously 2–3 mm. The glass fiber portion of a granulate amounts to 10–20 weight percent, advantageously approximately 15 weight percent. The irregularly arranged glass fibers must have a length 200–500 μm and the thickness of 1–2 μm. It is desirable to use a mixture of 2:1 to 3:1 glass fiber-reinforced to unfilled TETP granulate. A homogenous melt is produced from the granulate mixture in an injection casting machine at 300°–360° C. and a pressure over 1800, particularly approximately 1800–2200 bar in the injection casting mold. The selected temperatures and pressure for the inventive method lie therefore higher than normal.

It is important that in the tool which has a chamber mold for the supporting member and formed as a hollow chamber for pressing the hot synthetic plastic melt therein, zonally different temperatures are provided so that in the colder zones the synthetic plastic material is amorphous and in the warmer zones the synthetic plastic material is more or less crystalline in dependence on the temperature. All desired properties of the supporting member can be obtained zonally with the following parameters:

Mixing ratio of the granulate,
Melting temperature,
Pressing pressure,
Temperature in injection casting tool.

In the case of the orthopedic shoe insert, it has been shown that it is favorable when the synthetic plastic melt is pressed into the injection casting mold through an opening from the central foot head side. The synthetic plastic mass which enters a hollow chamber over relatively great cross-section flows very fast into the narrow zone of the heel region. Differently adjusted temperatures in the heel region and the central foot region of the injection casting mold provide different properties in the material. The material in the heel region is amorphous and the material in the central foot region rigidifies in more or less crystalline form, so that the desired elastic properties in the heel region and the desired stiffness in the central foot region are obtained. When glass fiber reinforced synthetic plastic material is used, it is necessary to be sure that a neighboring quantity of filling material, namely glass fibers, does not penetrate into the heel region as a filter, so that in this zone a synthetic plastic material with low glass fiber content is obtained. In the other zone, to the contrary, a respective higher glass fiber content is provided as compared with the initial melt. These differences in the composition provide the resulting optimal properties of the synthetic plastic material in the respective region.

The "glass fiber filtration" results not only from the narrowing of the heel region in the injection casting mold. In accordance with the inventive method, it is controlled by the different temperatures. For example, in the injection casting tool during the injection casting the heel region has temperatures of 40°–80° C. and the central foot region has temperatures of 80°–110° C.

In accordance with the present invention the properties of the synthetic plastic material in a one-piece supporting member can be adjusted as required from non-reinforced PETP and also from reinforced PETP by the selection of predetermined melt temperatures and injection pressures as well as by the selection of predetermined zonal different rigidification temperatures in the injection casting mold. These properties include the range of properties from spring-elastic properties, for example in the thin heel region of a shoe insert, to a stable stiffness in the central foot region, obtained for example by the thickness of the material and/or by the rigidification structure of the synthetic plastic and/or by the filling degree with glass fibers and/or by the crystallinity of the synthetic plastic material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
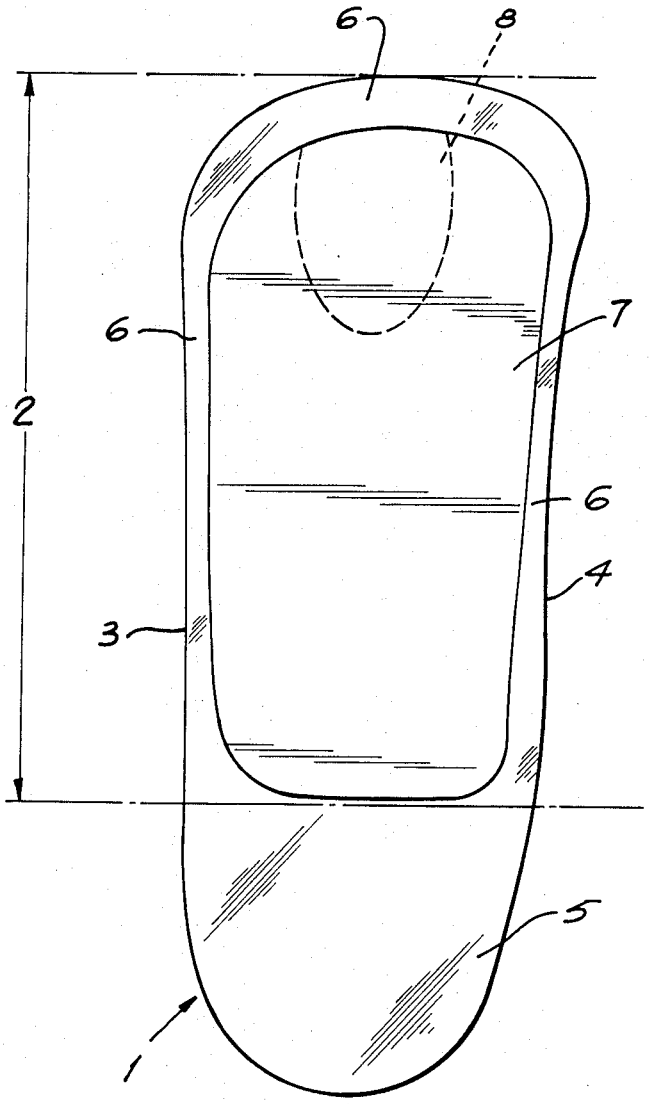
FIG. 1 is a plan view of a shoe insert in accordance with the present invention.
Figure 2:
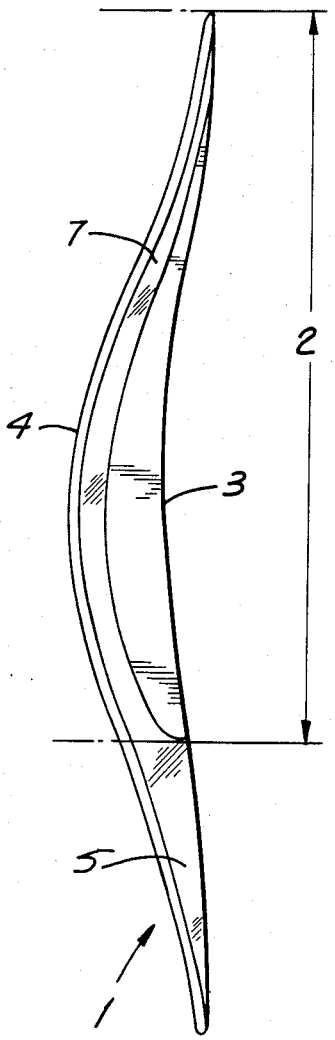
FIG. 2 is a side view of the shoe insert of the present invention.

A one piece shoe insert 1 in accordance with the present invention is formed for insertion into a left shoe. It has a curved supporting region or zone 2 for the central part of a foot and a heel region or zone 5 connected of one-piece with the supporting region 2.

The support region 2 supports with its outer region 3 the outer longitudinal curve and with its inner region 4 the inner longitudinal curve of a foot. The support region 2 ends at its front edge behind the central foot head of a foot, so that the insert does not extend over the entire length of the foot, but instead is located only under the central foot part and the heel.

In accordance with the present invention, the heel region 5 has a thinner material than the supporting region 2. In a special embodiment of the invention, the synthetic plastic material in the heel region is amorphous. In a further embodiment of the invention it is provided with a wider edge 6 of for example 2–8 mm, is arranged in the outer edge region of the supporting part 2 and is also composed of amorphous PETP, while a core region 7 is more or less crystalline. These differences can be easily recognizable, since the core region 7 is opaque while the edge region 6 and the heel region 5 are glass-transparent. In a further embodiment of the invention the crystalline core region 7 is encased at all sides by amorphous snythetic synthetic plastic material, so that the outer surface of the shoe insert is composed completely of amorphous synthetic plastic material. The thickness of the casing amounts to, for example, 0.5–2 mm.

This structure is of one-piece and produced in accordance with the present invention by the temperature condition in the tool. For example, the temperature in the tool during the rigidification of the synthetic plastic material is changed.

It is advantageous when the support region 2, especially the core region 7, is glass-fiber-reinforced, while the heel region 5 is glass-fiber-free or has a low content of glass fibers.

For example, the heel region can have a glass fiber content which is lower by 20%.

An after-deformation for adjusting to an individual foot shape is performed in the support region, while the heel region as a rule remains unchanged. For after-deformation, the support region is heated as a whole or zonally and deformed, for example by hand. After the deformation and cooling, the support region 2 assumes a new spatial shape. The stiffness can remain unchanged. It can, however, be also increased by the selected after-deformation temperature in that it is after-deformed at relatively high temperatures so that the crystallinity and therefore the stiffness is increased. It is especially advantageous that PETP, particularly also glass fiber-reinforced PETP, is after-deformable unlimitedly often, without affecting the required properties.

In accordance with the present invention, a pelotte (thin plate) 8 can be formed in the central foot curved region.

The orthopedical support member, particularly the shoe insert, in accordance with the present invention, can be produced in one working step in injection casting process. Based on the advantageous selection of the material, a combination of stiffness and elasticity in wide regions is guaranteed despite the one-piece construction. For after-deforming of the support member in correspondence to the body part to be supported, it is possible to change the shape by heating and in some cases also to change the stiffness, without losing the respective properties. It is possibleto produce standardized members, since afterwards any deformation of them can be done. This facilitates the manufacture and storage to a very considerable extent.

PETP is also available as a colored synthetic plastic material. Therefore the supporting members can be produced in different colors.

It will be understood that each of the elements described above, or two or more together, may also find a useful application in other types of constructions differing from the types described above.

While the invention has been illustrated and described as embodied in an orthopedic support part, particularly an orthopedic shoe insert, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An orthopedic support member, comprising a body part composed of polyethylene terephthalate having zones of different stiffnesses, said body part being formed as an orthopedic shoe insert including a curved support zone for a central foot part and a heel zone for a heel of the foot with said zones formed of one-piece with one another, said curved support zone being thick and stiff and bending-resistant, said heel zone being thin and elastic, said support zone having a core and an edge surrounding said core with said core composed of at least somewhat crystalline polyethylene terephthalate and said edge composed of amorphous polyethylene terephthalate, said heel zone being composed of amorphous polyethylene terephthalate, said shoe insert also having an amorphous casing which surrounds said crystalline core.

2. An orthopedic support member as defined in claim 1, wherein at least one of said zones is glass-fiber reinforced.

3. An orthopedic support member as defined in claim 1; and further comprising an additional material embedded in at least one of said zones.

4. An orthopedic support member as defined in claim 3, wherein said additional material is a fine-particle filling material.

5. An orthopedic support member as defined in claim 3, wherein said additional material is a reinforcing material.

6. An orthopedic support member as defined in claim 5, wherein said reinforcing material inserted in one zone is a glass-fiber reinforcing material.

7. An orthopedic support member as defined in claim 1, wherein said shoe insert has an amorphous casing which surrounds said crystalline core.

8. An orthopedic support member as defined in claim 1, wherein said casing has a thickness of approximately 0.5 mm.

9. An orthopedic support member as defined in claim 1, wherein said heel zone is provided with an additional material therein.

10. An orthopedic support member as defined in claim 9, wherein said additional material is a filling material.

11. An orthopedic support member as defined in claim 9, wherein said additional material is a reinforcing material.

12. An orthopedic support member as defined in claim 11, wherein said reinforcing material is a glass fiber reinforcing material.

13. An orthopedic support member as defined in claim 9, wherein said support zone also has an additional material, said heel zone having a lower content of the additional material than said support zone.

14. An orthopedic support member as defined in claim 1; and further comprising a pelotte formed on said body part.

15. An orthopedic support member, comprising a body part composed of polyethylene terephthalate having zones of different stiffnesses, said body part being formed as an orthopedic shoe insert including a curved support zone for a central foot part and a heel zone for a heel of the foot with said zones formed of one-piece with one another, said support zone being stiff and bending-resistant and having a core composed of at least somewhat crystalline polyethylene terephthalate, said heel zone being elastic and composed of amorphous polyethylene terephthalate.

* * * * *